US011871805B2

(12) United States Patent
Bailey et al.

(10) Patent No.: US 11,871,805 B2
(45) **Date of Patent: *Jan. 16, 2024**

(54) GARMENT WITH ZONED INSULATION AND VARIABLE AIR PERMEABILITY

(71) Applicant: NIKE, Inc., Beaverton, OR (US)

(72) Inventors: Collin Bailey, Milwaukie, OR (US); Olivia A. Echols, Portland, OR (US); Rebecca P. Hurd, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 87 days.

This patent is subject to a terminal disclaimer.

(21) Appl. No.: 17/143,656

(22) Filed: Jan. 7, 2021

(65) Prior Publication Data

US 2021/0120894 A1 Apr. 29, 2021

Related U.S. Application Data

(62) Division of application No. 15/683,931, filed on Aug. 23, 2017, now Pat. No. 10,973,268.

(60) Provisional application No. 62/379,466, filed on Aug. 25, 2016.

(51) Int. Cl.

| | |
|---|---|
| ***A41D 27/28*** | (2006.01) |
| ***D04B 1/16*** | (2006.01) |
| ***A41D 31/00*** | (2019.01) |
| ***A41D 31/14*** | (2019.01) |
| ***D04B 1/24*** | (2006.01) |

(52) U.S. Cl.

CPC ..... *A41D 27/28* (2013.01); *A41D 31/00* (2013.01); *A41D 31/14* (2019.02); *D04B 1/16* (2013.01); *D04B 1/24* (2013.01); *A41D 2500/10* (2013.01)

(58) Field of Classification Search

CPC ..... D10B 2401/02

See application file for complete search history.

(56) References Cited

U.S. PATENT DOCUMENTS

| | | | |
|---|---|---|---|
| 252,552 | A | 1/1882 | Vermilyea et al. |
| 280,750 | A | 7/1883 | Levy |
| 561,558 | A | 6/1896 | Bellins |
| 693,409 | A | 2/1902 | Leighton |

(Continued)

FOREIGN PATENT DOCUMENTS

| | | | | |
|---|---|---|---|---|
| CN | 101374991 A | * | 2/2009 | ..... D02G 3/04 |
| CN | 102599664 A | | 7/2012 | |

(Continued)

OTHER PUBLICATIONS

Espacenet Translation of CN101374991A, translation produced on May 27, 2022 (Year: 2022).*

(Continued)

*Primary Examiner* — Jocelyn Bravo

(74) *Attorney, Agent, or Firm* — SHOOK, HARDY & BACON L.L.P.

(57) ABSTRACT

Aspects herein relate to a textile knitted with an adaptive yarn that incorporates insulation features as well as variable air permeability features. The adaptive textile may exhibit a baseline level of insulation. The adaptive textile is configured to exhibit a first air permeability when unexposed to a physical stimulus such as water and a second air permeability when exposed to the physical stimulus where the second air permeability is greater than the first air permeability.

16 Claims, 10 Drawing Sheets

(56) References Cited

U.S. PATENT DOCUMENTS 709,828 A 9/1902 Scott
709,839 A 9/1902 Williams
709,840 A 9/1902 Williams
865,279 A 9/1907 Steber
1,067,952 A 7/1913 Volz
1,577,752 A 3/1926 Price
RE16,584 E 4/1927 Lawson
1,976,885 A 10/1934 Nathan
1,994,482 A 3/1935 Pelton
2,009,361 A 7/1935 John
2,040,318 A 5/1936 Vincent
2,319,340 A 5/1943 Max
2,320,989 A 6/1943 Max
2,378,780 A 6/1945 Vincent
2,379,852 A 7/1945 Max
2,384,079 A 9/1945 Davis
2,435,897 A 2/1948 Milton
2,696,723 A 12/1954 Frith, Jr.
2,741,108 A 4/1956 Lionel
2,741,825 A 4/1956 Runton et al.
2,800,782 A 7/1957 Bridges
2,815,558 A 12/1957 Albert et al.
2,836,970 A 6/1958 Jaroslav et al.
2,974,508 A 3/1961 Twain
3,040,551 A 6/1962 Urlaub
3,066,513 A 12/1962 Leybourne
3,111,829 A 11/1963 Walter
3,153,793 A 10/1964 Lepore
3,219,514 A 11/1965 Roysanc
3,230,917 A 1/1966 Norman et al.
3,241,337 A 3/1966 Stevens, Jr.
3,250,095 A 5/1966 Bird
3,259,915 A * 7/1966 Dison ..... A41B 11/005 D2/980
3,264,846 A 8/1966 Bruno
3,296,626 A 1/1967 Ludwikowski
3,468,139 A 9/1969 Bitzer
3,561,441 A 2/1971 Lombardi
3,654,054 A 4/1972 Waller
3,703,432 A 11/1972 Koski
3,760,611 A 9/1973 Duckworth
3,793,851 A * 2/1974 Thorneburg ..... D04B 1/26 66/185
3,796,067 A * 3/1974 East ..... D04B 1/26 66/178 R
3,853,680 A 12/1974 Daniel
4,047,400 A * 9/1977 Thorneburg ..... A41D 20/00 66/190
4,104,892 A * 8/1978 Thorneburg ..... A41B 11/02 66/178 R
4,125,001 A 11/1978 Bryars
4,185,327 A 1/1980 Markve
4,194,249 A * 3/1980 Thorneburg ..... A41B 11/02 66/182
RE30,638 E 6/1981 Bryars
4,277,959 A * 7/1981 Thorneburg ..... D04B 1/02 66/185
4,322,232 A 3/1982 Beane
4,350,725 A 9/1982 Pflueger
4,373,361 A * 2/1983 Thorneburg ..... D04B 1/26 2/241
4,390,999 A 7/1983 Lawson et al.
4,408,356 A 10/1983 Abrams
4,438,533 A 3/1984 Hefele
4,647,492 A 3/1987 Grant et al.
4,702,091 A 10/1987 Good et al.
4,732,015 A 3/1988 Abrams et al.
4,733,546 A 3/1988 Toda
4,794,767 A 1/1989 Lombardi
4,905,692 A 3/1990 More
4,998,419 A * 3/1991 Moore ..... D04B 1/02 66/25
5,016,450 A 5/1991 Pernick
5,033,116 A 7/1991 Itagaki et al.
5,040,245 A 8/1991 Staley
5,095,548 A 3/1992 Chesebro, Jr.
5,282,277 A 2/1994 Onozawa
5,335,517 A 8/1994 Throneburg et al.
5,515,543 A 5/1996 Gioello
5,603,232 A * 2/1997 Throneburg ..... D04B 1/02 66/178 R
5,896,758 A 4/1999 Rock et al.
5,918,319 A 7/1999 Baxter
6,339,845 B1 1/2002 Burns et al.
6,803,334 B2 * 10/2004 Mizutani ..... A61F 13/512 604/382
7,234,171 B2 6/2007 Rowe et al.
7,437,774 B2 10/2008 Baron et al.
8,336,117 B2 12/2012 Carter et al.
8,424,116 B2 * 4/2013 Anastsopoulos ..... D04B 1/26 2/239
8,726,414 B2 5/2014 Baron et al.
9,060,551 B2 6/2015 Nordstrom et al.
9,668,530 B2 * 6/2017 Miller ..... A43B 5/18
9,700,077 B2 7/2017 Baron et al.
9,961,943 B2 5/2018 Klein
10,060,054 B2 8/2018 Weening et al.
10,251,436 B2 4/2019 Carter et al.
10,413,006 B2 9/2019 Carter et al.
2002/0104576 A1 8/2002 Howland
2002/0155773 A1 10/2002 Maini
2004/0022993 A1 2/2004 Wildeman
2004/0029473 A1 2/2004 Mckee et al.
2004/0077241 A1 4/2004 Campbell et al.
2005/0003139 A1 * 1/2005 Keller ..... D04B 21/02 428/92
2005/0003142 A1 * 1/2005 Williamson ..... D05C 17/02 428/397
2005/0053759 A1 3/2005 Rock et al.
2005/0183216 A1 8/2005 Harriss et al.
2005/0204449 A1 9/2005 Baron et al.
2005/0208860 A1 * 9/2005 Baron ..... D04H 3/00 442/374
2006/0060257 A1 3/2006 Iwashita
2006/0080754 A1 4/2006 Baron et al.
2006/0223400 A1 * 10/2006 Yasui ..... D04B 1/16 442/304
2007/0094762 A1 5/2007 Carter et al.
2008/0085398 A1 * 4/2008 Yasui ..... D03D 15/292 428/152
2008/0168591 A1 7/2008 Feduzi et al.
2008/0189824 A1 * 8/2008 Rock ..... D04B 1/04 36/43
2008/0229473 A1 9/2008 Baron et al.
2008/0254263 A1 * 10/2008 Yasui ..... A41D 31/125 428/172
2009/0044313 A1 * 2/2009 Anastsopoulos .... A41B 11/003 2/241
2010/0130903 A1 * 5/2010 Rock ..... D04B 1/243 602/62
2011/0177294 A1 7/2011 Rock et al.
2013/0239625 A1 9/2013 Tatler et al.
2015/0315728 A1 * 11/2015 Yang ..... D04B 9/06 66/13
2015/0366281 A1 * 12/2015 Miller ..... B32B 5/022 428/137
2017/0340027 A1 * 11/2017 Montoya ..... A41D 3/02
2018/0055117 A1 3/2018 Bailey et al.

FOREIGN PATENT DOCUMENTS

CN 203058371 U 7/2013
CN 105495797 A 4/2016
EP 0062969 A2 10/1982
EP 1676944 A1 7/2006
JP 2003-41462 A 2/2003
JP 2003041462 A * 2/2003

OTHER PUBLICATIONS

Clarivate Analytics Description Translation of CN101374991A,

(56) References Cited

OTHER PUBLICATIONS translation produced on May 27, 2022 (Year: 2022).*
Espacenet Translation of JP 200341462A, translation produced on May 27, 2022 (Year: 2022).*
"Everything You Need to Know about Nylon", Creative Mechanisms, Available Online at <https://www.creativemechanisms.com/blog/3d-printing-injection-molding-cnc-nylon-plastic-pa>, Mar. 10, 2016, 15 pages.

* cited by examiner

GARMENT WITH ZONED INSULATION AND VARIABLE AIR PERMEABILITY

CROSS-REFERENCE TO RELATED APPLICATIONS

This application, and titled, "Garment with Zoned Insulation and Variable Air Permeability," is a Divisional Application of U.S. application Ser. No. 15/683,931, filed Aug. 23, 2017, and titled "Garment with Zoned Insulation and Variable Air Permeability," which claims priority to U.S. Prov. App. No. 62/379,466, filed Aug. 25, 2016, and titled "Garment with Zoned Insulation and Variable Air Permeability." The entireties of the aforementioned applications are incorporated by reference herein.

TECHNICAL FIELD

The present disclosure relates to a garment having insulation zones with variable air permeability characteristics.

BACKGROUND

Garments configured for cold weather typically use some type of insulation to provide warmth to the wearer. The insulation is generally uniformly dispersed over the garment.

BRIEF DESCRIPTION OF THE DRAWINGS

Examples of the present invention are described in detail below with reference to the attached drawing figures, wherein.

DETAILED DESCRIPTION

Figure 1:
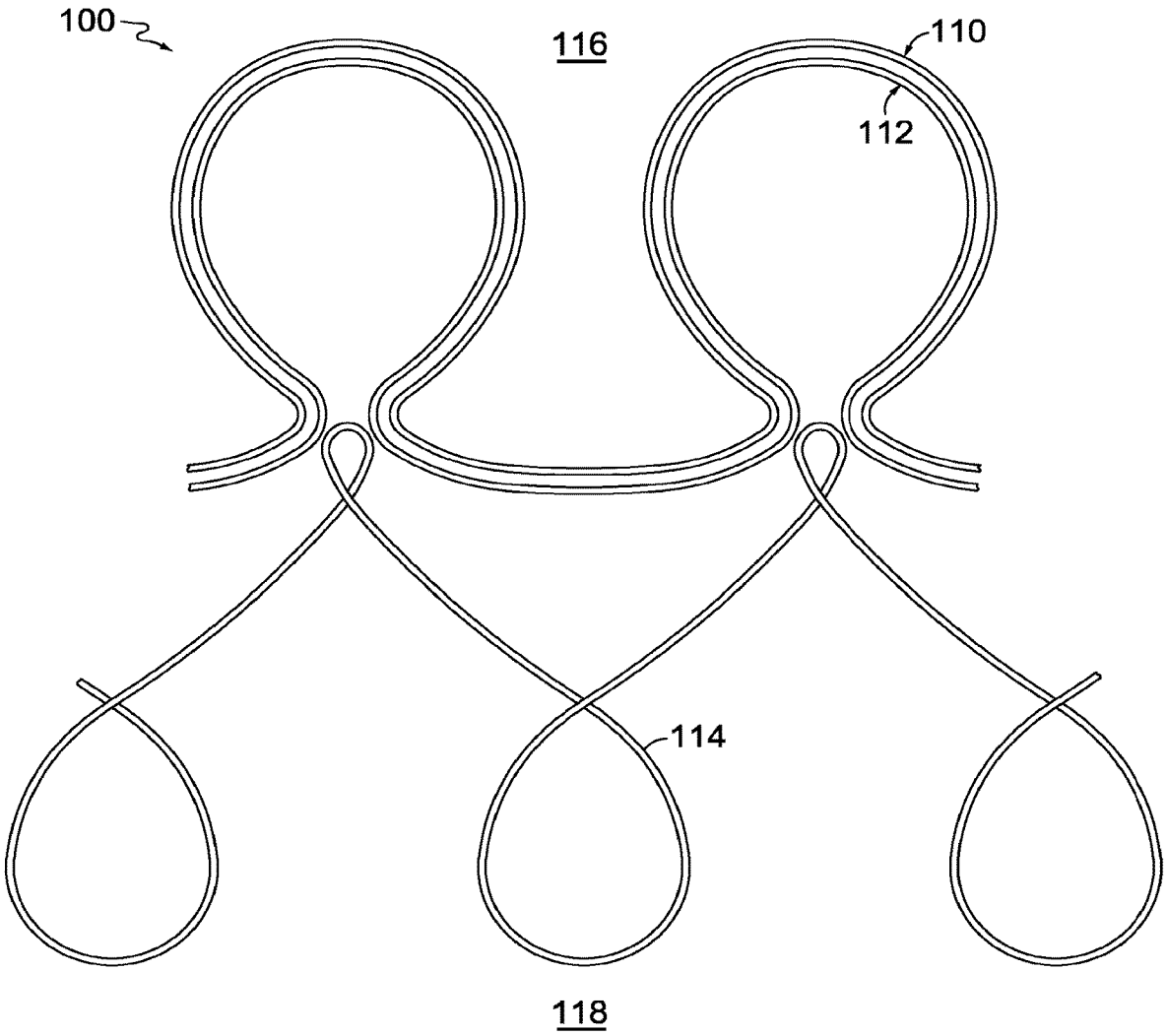
FIG. 1 illustrates an exemplary knit structure in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to a textile knitted with an adaptive yarn that incorporates insulation features as well as variable air permeability features. For instance, the adaptive textile may exhibit a baseline level of insulation. As well, the adaptive textile is configured to exhibit a first air permeability when unexposed to a physical stimulus such as water and a second air permeability when exposed to the physical stimulus where the second air permeability is greater than the first air permeability. As used throughout this disclosure, the term "water" is meant to encompass substances such as sweat or perspiration. In exemplary aspects, the knitted textile comprises a single knit jersey with terry loops on one surface of the textile.

More specifically, the adaptive textile is formed using at least a first yarn that is dimensionally stable upon exposure to a physical stimulus such as water, a second yarn that dimensionally transforms when exposed to the physical stimulus, and a third yarn that is dimensionally stable when exposed to the physical stimulus. In exemplary aspects, the first yarn is knit to form a first surface of the textile, and the second yarn is plated with the first yarn such that it is generally positioned under the first yarn in the knitted textile. The third yarn is mechanically manipulated to create terry loops that form the second opposite surface of the textile. In one exemplary aspect, the terry loops are clustered together to form discrete projections that extend away from the second surface of the textile (i.e., extend in the z-direction). In one aspect, the projections may have terminal ends located opposite the surface plane of the textile. The projections may be arranged in a tessellation pattern that maximizes the number of projections per unit area, and spaces may be formed between adjacent projections.

When the adaptive textile is incorporated into a garment, such as a garment configured for cold-weather conditions, the textile may be strategically positioned on the garment such that it is located adjacent to, for instance, high heat or sweat producing areas of the wearer when the garment is worn. The second surface may comprise an inner-facing surface of the garment, and the first surface may help to form an outer-facing surface of the garment. As such, the projections formed by the terry loops may come into contact or near contact with the wearer's body when the garment is worn helping to maintain heated air produced by the wearer in contact with the wearer's body. Because of the large surface area of the projections produced by use of the terry loops, the projections may help to "trap" heated air and may reduce opportunities for the heated air to be channeled away from the wearer's body. This is helpful when the wearer is at rest or is generating minimal body heat. However, when the wearer begins to perspire due to, for example, exercise or an increase in temperature, the projections may help transport the perspiration to the second yarn causing the second yarn to undergo a dimensional transformation from a crimped state to a straight or flat state. This results in an increase in size of the openings formed between the yarn loops, which, in turn, increases the air permeability of the textile. The increase in air permeability may help to dissipate wearer-generated heat and/or moisture vapor and thereby cool the wearer. The result is a garment that is able to provide both insulation when needed such as when a wearer is resting, and cooling when needed such as when the wearer is active or exercising.

Accordingly, aspects herein are directed to a garment comprising a first garment portion formed of a first material having a first surface and a second surface. The first material is formed using at least a first yarn that is dimensionally stable upon exposure to water, and a second yarn that exhibits a dimensional transformation upon absorbing water, where the second yarn is plated with the first yarn such that the first yarn generally forms the first surface of the first material and the second yarn is generally positioned under the first yarn. The first material is further formed using a third yarn that forms the second surface of the first material. The third yarn is mechanically manipulated to form a plurality of projections that extend from the second surface, where each of the plurality of projection has a terminal end located opposite the second surface of the first material.

In another aspect, a knitted textile is provided. The knitted textile comprises a first surface and a second opposite surface, a first yarn that is dimensionally stable upon exposure to water, and a second yarn that exhibits a dimensional transformation upon absorbing water, where the second yarn is plated with the first yarn such that the first yarn generally forms the first surface of the textile and the second yarn is generally positioned under the first yarn. The knitted textile further comprises a third yarn that forms the second surface of the first material, where the third yarn is mechanically manipulated to form a plurality of projections that extend from the second surface, where each of the plurality of projection has a terminal end located opposite the second surface.

In yet another aspect, a garment is provided. The garment comprises a torso region having at least a front area, a back area, a first arm opening and a second arm opening, a first side area extending from proximate the first arm opening to proximate a waist opening of the garment, and a second side area extending from proximate the second arm opening to proximate the waist opening of the garment, where at least the front area, the back area, and the first and second side areas are adapted for covering a torso of a wearer when the garment is in an as-worn configuration. At least a first portion of the garment is formed from a first material having a first surface and a second surface, where the first material comprises a knitted material formed using at least a first yarn that is dimensionally stable upon exposure to water, and a second yarn that exhibits a dimensional transformation upon absorbing water. The second yarn is plated with the first yarn such that the first yarn generally forms the first surface of the first material and the second yarn is generally positioned under the first yarn. The knitted material is further formed using a third yarn that is dimensionally stable upon exposure to water, where the third yarn forms the second surface of the first material. The third yarn is mechanically manipulated to form a plurality of projections that extend from the second surface, where each of the plurality of projection has a terminal end located opposite the second surface of the first material.

As used throughout this disclosure, directional terms such as front, back, side, anterior, posterior, superior, inferior, inner-facing, outer-facing, and the like are to be given their common meanings with respect to a garment being worn as intended by a wearer standing in anatomical position. Terms such as "configured to cover [a designated body part of a wearer]" are to be construed with respect to a garment that is appropriately sized for a particular wearer. Terms such as "proximate" mean within 0.5 cm to 40 cm from the indicated area.

Turning now to FIG. 1, an exemplary knit structure 100 is provided in accordance with aspects herein. Use of a knit construction as described herein may inherently provide a greater level of baseline air permeability due to the interlooping nature of the knit construction as compared to, for instance, weaving constructions. In other words, a knit structure may inherently have a greater number and/or surface area of spaces formed between knit loops as compared to a woven structure. The knit structure 100 is formed using at least a first yarn 110, a second yarn 112 that is plated with the first yarn 110, and a third yarn 114. In exemplary aspects, the first yarn 110 may comprise a yarn that is dimensionally stable upon exposure to a physical stimulus such as, for example, water, increased temperature, wind, light energy, magnetic energy, and the like. In other words, the first yarn 110 does not undergo a measurable change in dimension or characteristics (i.e., length, thickness, degree of crimp, for example) when exposed to a physical stimulus. In exemplary aspects, the first yarn 110 may comprise a 20 gauge, 150 denier, 144 filament semi-dull heather polyester yarn. Formulations for the fiber or filament content of the first yarn 110 may comprise, for example, a 50% regular non-absorptive polyester and a 50% cationic dyeable polyester yarn that is also non-absorptive. Other formulations for the fiber or filament content of the first yarn 110 are contemplated herein. As well, other non-absorptive polymer fibers or filaments are contemplated herein such as rayon, nylon, polyacrylic, and the like.

The second yarn 112 may comprise a yarn that dimensionally transforms (i.e., undergoes a change in length, thickness, degree of crimp, and the like) upon exposure to a physical stimulus such as water (in a liquid or gaseous state), increased temperature, moving air, light energy, magnetic energy, and the like. An exemplary yarn may be manufactured by Teijin Fibers Limited of Japan. With respect to water, the dimensional transformation may occur relatively quickly (such as under 30 seconds) due to, for instance, immersion or contact with liquid water. Alternatively, the transformation may occur more slowly due to prolonged exposure to air with a relative humidity above, for instance, 75%.

In exemplary aspects, the second yarn 112 may comprise a 20 gauge 75 denier/24 filament semi-dull bi-component yarn or a 50 denier/24 filament semi-dull bi-component yarn. In exemplary aspects, the 75 denier/24 filament yarn may exhibit less crimp than the 50 denier/24 filament yarn but may exhibit a higher stability (i.e., a longer shelf life). Formulations for the fiber or filament content of the second yarn 112 may comprise, for instance, a 50% modified cationic dyeable polyester that is non-absorptive and a 50% moisture-absorbing polycaprolactam or Nylon 6. In one exemplary aspect, the second yarn 112 is formed using an air intermingling process to combine the polycaprolactam fibers or filaments with the modified cationic dyeable polyester fibers or filaments. In general, polycaprolactam or Nylon 6 exhibits a moisture regain of approximately 4.1%, while the modified cationic dyeable polyester fibers or filaments may exhibit a moisture regain of 0.2-0.4% where moisture regain may be defined as the weight of water in a material as a percentage of the oven dry weight. Thus, use of these two types of fibers or filaments may enable a moisture regain differential sufficient to induce a dimensional change in the second yarn 112. The 50% modified cationic dyeable polyester fibers or filaments and the 50% moisture-absorbing polycaprolactam or Nylon 6 fibers or filaments are generally arranged in a side-by-side manner with minimal twist between the different fiber/filament groups to generate a yarn with a generally round cross-section.

In one exemplary aspect, the cationic dyeable polyester fibers or filaments in the second yarn 112 are modified so that they will better adhere to the polycaprolactam or Nylon 6 fibers or filaments. In an exemplary aspect, the cationic dyeable polyester fibers or filaments may be modified by increasing the number of cations and anions. The higher cationic content may cause a greater amount of adhesion to the polycaprolactam or Nylon 6 fibers or filaments than traditional cationic dyeable polyester fibers or filaments. This, in turn, may lower the melting temperature and may lower the degree of crystallinity of the modified cationic dyeable polyester fibers or filaments. Because of this, the cationic dyeable polyester fibers or filaments in the second yarn 112 may exhibit a greater affinity to dyes (disperse dyes and cationic dyes) than cationic dyeable polyester fibers or filaments used in the first yarn 110 and/or the third yarn 114. In other words, the modified cationic dyeable polyester fibers or filaments in the second yarn 112 may absorb dyes to a greater extent than the first yarn 110 or the third yarn 114 and thus appear darker than these yarns after dyeing.

Continuing, to account for the difference in color between, for instance, the first yarn 110 and the second yarn 112 after dyeing, a heather yarn may be used for the first yarn 110. To help understand this, and as will be explained further below, after being incorporated into a textile, the first yarn 110 may form, for example, an outer-facing surface of the textile. Moreover, the first yarn 110 is plated with the second yarn 112. However, due to imperfections in the plating process, the second yarn 112 may occasionally show through on the outer-facing surface of the textile. Use of a heather yarn for the first yarn 110 helps to conceal, camouflage, or hide the darker-dyed second yarn 112 because heather yarns possess both lighter and darker-colored areas.

Other formulations for the fiber or filament content of the second yarn 112 are contemplated herein such as: 1) 70% non-absorptive polyester and 30% moisture-absorptive polyester; 2) 80% non-absorptive polyester and 20% moisture-absorptive polyester; 3) 80% percent cationic dyeable polyester that is generally non-absorptive and 20% moisture-absorptive polyester, and the like. As seen, the percentage of the fibers or filaments formed from moisture-absorptive materials may vary considerably within the scope of aspects herein. In each of the examples provided above, a non-absorptive or otherwise dimensionally stable polyester fiber or filament is combined with a moisture-absorptive material to form a bi-component yarn. Other non-absorptive materials may be used herein such as rayon, nylon, polyacrylic, and the like. In exemplary aspects, the second yarn 112 may comprise between 20-30% and/or between 22-26% of the yarns in the finished textile.

In exemplary aspects, the third yarn 114 may comprise a yarn that is dimensionally stable upon exposure to a physical stimulus such as water. In one exemplary aspect, the third yarn 114 may comprise a 20 gauge, 100 denier, 144 filament semi-dull, 100% non-absorptive polyester yarn, while in another exemplary aspect, the third yarn 114 may comprise a 75 denier, 36 filament semi-dull 100% non-absorptive polyester yarn or a 75 denier, 72 filament semi-dull, 100% non-absorptive polyester yarn. It is also contemplated herein that a cationic dyeable non-absorptive polyester yarn may be used for the third yarn 114 alone or in combination with regular polyester fibers or filaments (i.e., a 50% regular non-absorptive polyester and a 50% cationic dyeable polyester yarn). Utilizing different denier/filament ratios may be useful in providing greater or lesser degrees of insulation. For instance, the 100 denier, 144 filament yarn may provide a higher degree of insulation when formed into the terry loops as compared to the 75 denier/36 filament yarn. It is contemplated that other non-absorptive fibers or filaments such as rayon, nylon, polyacrylic, and the like may be used herein. The use of polyester fibers and/or filaments as described herein may be advantageous due to the high abrasion resistance, tenacity, resiliency, dimensional stability, and elastic recovery of polyester fibers and/or filaments.

Regarding the construction of the knit structure 100, the second yarn 112 is plated with the first yarn 110 such that the second yarn 112 generally lies under, and/or is positioned adjacent, the first yarn 110 in the finished textile or fabric. The first and second yarns 110 and 112, in exemplary aspects, may be knit in a single jersey pattern to form a first face or first surface 116 of the resulting textile or fabric. In general, the first yarn 110 forms the majority of the first surface 116. As is known in the art of knitting, a plated structure contains loops composed of at least two yarns, each separately supplied through its own guide or guide hole to the needle hook in order to influence its respective position relative to the surface of the textile. Due to factors such as physical properties of the yarns, however, the yarn positioned underneath the face yarn (the second yarn 112 in this case) may occasionally show through on the face of the textile. Thus, when describing the first yarn 110 as forming the majority of the first surface 116, it is contemplated herein that the majority may comprise up to 80%, 85%, 90%, 95% or greater of the first surface 116.

Continuing, plating the second yarn 112 with the first yarn 110 may be important in helping to "lock-down" or securing the second yarn 112. Considering that the second yarn 112 undergoes a dimensional transformation when exposed to a physical stimulus, locking down or securing this yarn via the plating and interlooping process with the first yarn 110 may be important for constraining, at least partially, some of the dimensional changes of the second yarn 112 so that a garment incorporating the knit structure 100 does not generally deform, bag, or sag to an appreciable degree when the second yarn 112 transitions from, for instance, a crimped state to a flat or straight state. To avoid locking down the second yarn 112 too much such that the dimensional transformation of the second yarn 112 is negated or overly inhibited by the lockdown or interlooping construction, a single knit construction may be ideal. This construction has been found to facilitate a measurable change in air permeability due to the dimensional transformation of the second yarn 112 while still providing sufficient lockdown so that any garments incorporating the knit construction as described herein maintain their general shape. Moreover, use of a single knit construction may allow for production of a lightweight garment.

Continuing, the third yarn 114 is used to form a terry loop on the second face or second surface 118 of the resulting textile. Thus, in a finished textile, the first yarn 110 would form the majority of a first surface 116 of the textile, and the third yarn 114 would form the second opposite surface 118 of the textile. The second yarn 112 would generally be positioned between the first yarn 110 and the third yarn 114 (and/or between the first surface 116 and the second surface 118) in the finished textile. Other knit constructions are contemplated herein such as, for example, a double knit pique structure, and the like.

Figure 2:
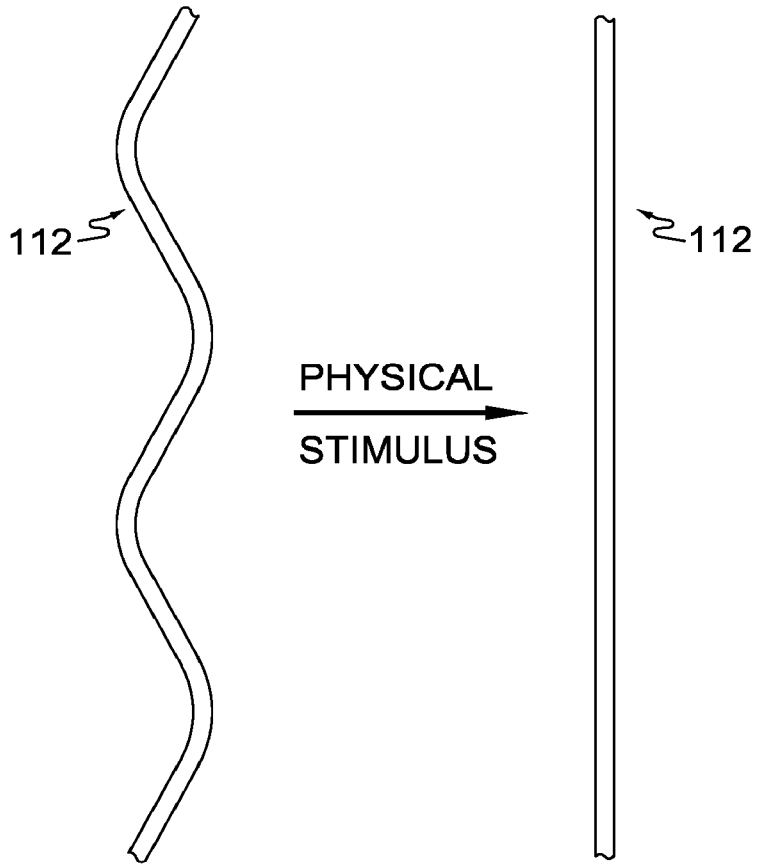
FIG. 2 illustrates an exemplary adaptive yarn in accordance with aspects herein.

FIG. 2 illustrates an exemplary second yarn 112 in a crimped and uncrimped state in accordance with aspects herein. For instance, the second yarn 112 to the left of the arrow is shown in a crimped state where the degree of crimp may be thought of as a measure of the waviness in the yarn. The crimped state may exist when the second yarn 112 has not been exposed to a physical stimulus such as, for example, water or moisture vapor. In one exemplary aspect, the yarn 112 may not assume a crimped state until after the yarn 112 has undergone a dyeing process. For instance, during fabric dyeing, the second yarn 112 may be activated when exposed to a predetermined temperature and moisture level for a predetermined period of time. Activation causes the second yarn 112 to crimp into a textured state because of the differential shrinkage of the side-by-side non-absorptive fibers or filaments and the absorptive fibers or filaments. In exemplary aspects, the polycaprolactam or Nylon 6 fibers or filaments shrink to a greater degree than the cationic dyeable polyester fibers or filaments to create the crimp configuration. The second yarn 112 maintains the crimped state after activation until exposed to a stimulus as explained below.

The yarn 112 shown to the right of the arrow has undergone a dimensional transformation upon exposure to a physical stimulus such as, for example, water. As shown, the second yarn 112 has gone from a crimped state to a generally non-crimped or flat state. In exemplary aspects, the transition from a crimped to an uncrimped or flat state may cause an increase in the length of the yarn 112. And as described above, it may be important to constrain the change in dimensions of the second yarn 112 by plating it with the first yarn 110 to prevent unintentional bagging or sagging of a garment incorporating the second yarn 112 after exposure to the physical stimulus. Other dimensional transformations of the second yarn 112 are contemplated herein such as an increase or decrease in the diameter of the yarn 112, an increase or decrease in the length of the yarn 112, and the like.

Figure 3A:
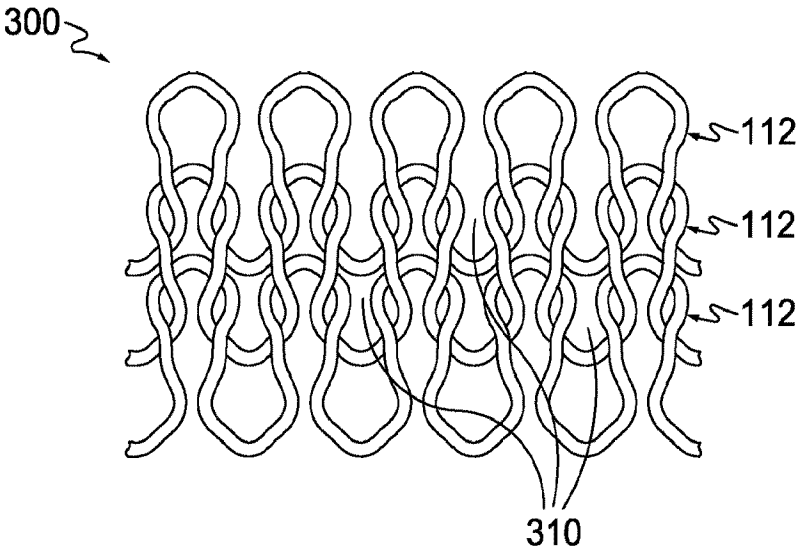
FIG. 3A illustrates an exemplary knit structure using adaptive yarns when unexposed to a physical stimulus in accordance with aspects herein.
Figure 3B:
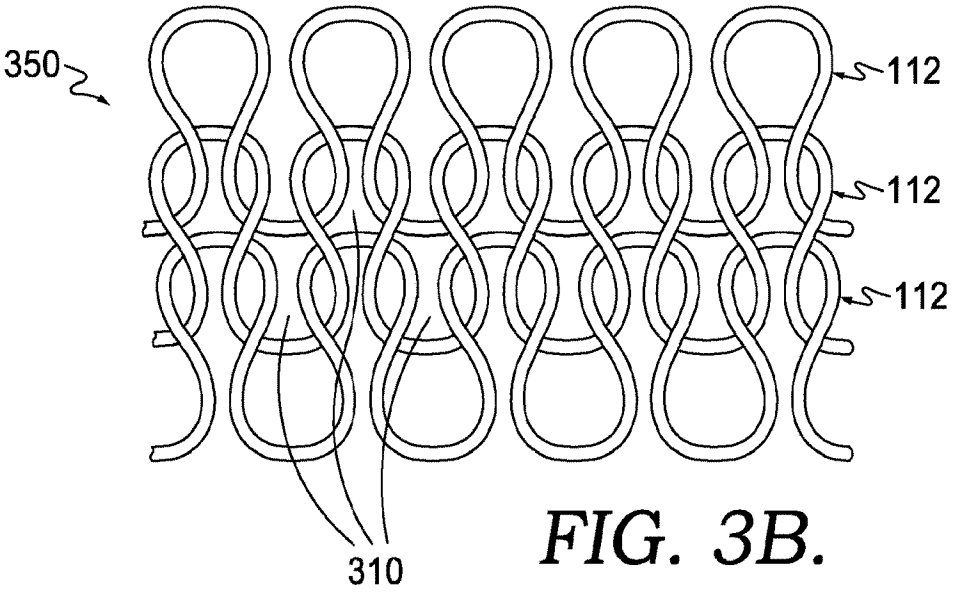
FIG. 3B illustrates the exemplary knit structure of FIG. 3A when exposed to a physical stimulus in accordance with aspects herein.

FIGS. 3A and 3B illustrate the second yarn 112 knitted to form a series of interlocking loops in accordance with aspects herein. The second yarn 112 is shown by itself for illustration purposes, but, as described above with respect to the knit structure 100, the second yarn 112 would be plated with the first yarn 110, and the third yarn 114 would form a series of terry loops on the second surface. More specifically, FIG. 3A illustrates a knit structure 300 incorporating the second yarn 112 in a crimped state, and FIG. 3B illustrates a knit structure 350 with the second yarn 112 in an uncrimped or flat state. In other words, the knit structure 300 occurs before the second yarn(s) 112 has been exposed to a physical stimulus such as, for instance, water, and the knit structure 350 occurs after the second yarn(s) 112 has been exposed to a physical stimulus such as water.

By virtue of the interlooping construction, spaces, such as spaces 310, are formed in the knit structures 300 and 350. However, because the yarn(s) 112 is crimped in the knit structure 300, the average area of the spaces 310 in the knit structure 300 is generally smaller than the average area of the spaces 310 in the knit structure 350 where the yarn(s) 112 is straight or uncrimped. Increasing the average area of the spaces 310 when going from a crimped state (FIG. 3A) to an uncrimped state (FIG. 3B)) causes a resultant increase in overall permeability of the knit structure 350 to, for instance, water, light, air, and the like.

For example, when the second yarn 112 is incorporated into a textile with the first yarn 110, and the third yarn 114 as described above, and when the textile is exposed to a physical stimulus such as water, the textile may exhibit a positive change in air permeability as measured using, for example, ASTM D737—Standard Test Method for Air Permeability of Textile Fabrics. This testing method is performed on both wet and dry specimens. In other words, the air permeability is measured on both wet and dry specimens. In exemplary aspects, the test method may be modified by decreasing the pressure differential to 20 Pa (versus 125 Pa in the ASTM D737 test) to prevent the wet textile from drying out and to more closely approximate the air flow and/or air pressure experienced by, for instance, a runner while running.

More particularly, when the textile comprising the second yarn 112 is exposed to a physical stimulus such as water, the textile may have may have a 16.0-17.0%, a 16.0-16.5%, or a 16.1%-16.3% positive change in air permeability measured before the textile has been washed. For example, the textile may exhibit an air permeability of between 25.5 $ft^3/min/ft^2$ and 30.0 $ft^3/min/ft^2$ when dry and before being washed and an air permeability between 32.0 $ft^3/min/ft^2$ and 32.5 $ft^3/min/ft^2$ when wet and before being washed. After washing, the textile may have a 23.0-39.0%, a 26.0-28.0%, or a 26.0-27.0% positive change in air permeability. For instance, the textile may exhibit an air permeability of between 17.4 $ft^3/min/ft^2$ and 17.9 $ft^3/min/ft^2$ when dry and after being washed and an air permeability between 22.4 $ft^3/min/ft^2$ and 22.8 $ft^3/min/ft^2$ when wet and after being washed.

Continuing, this is compared to a textile that does not incorporate the second yarn 112 which may have a 9.0-9.5% negative change in air permeability before the textile has been washed and when exposed to a physical stimulus such as water and a 2.0 to 3.0% negative change in air permeability after the textile has been washed and when exposed to the physical stimulus.

A positive change in air permeability generally means that the textile is becoming more permeable, while a negative change in air permeability generally means the textile is becoming less permeable. A negative change in air permeability may be due to, for instance, the water being trapped between the yarns in the knit structure thereby inhibiting the passage of air through the yarn spaces. Further, the differences in percentage change in air permeability before and after wash may be ascribed to shrinkage of the textile that occurs after washing. For instance, when the textile shrinks, a "tighter" knit structure is produced which may limit air permeability. As can be seen with the percent change in air permeability for the textile incorporating the second yarn 112, the percent change in air permeability is higher after washing. The reason for this is as follows: although the air permeability measured after washing and before the stimulus is applied may be smaller as a result of shrinkage, the air permeability increase after the textile is exposed to the physical stimulus (water in this case) approaches a value close to what it was before washing resulting in an overall greater percentage change as compared to the percentage change before washing.

Figure 4:
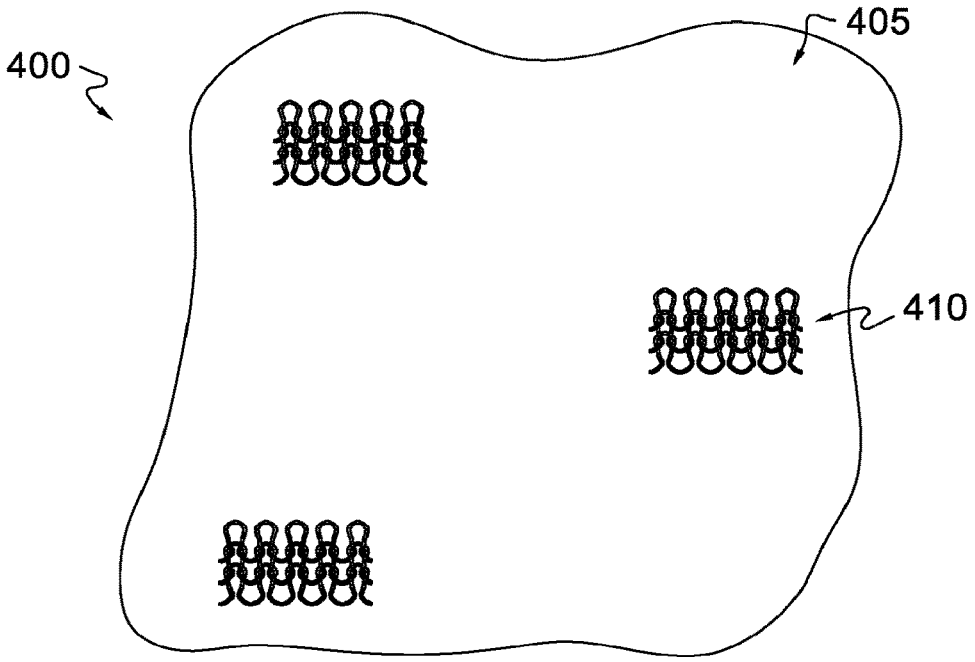
FIG. 4 illustrates a first surface of an exemplary textile incorporating the exemplary knit structure of FIG. 1 in accordance with aspects herein.

Turning now to FIG. 4, a first surface 405 of a textile 400 incorporating the knit structure 100 is illustrated in accordance with aspects herein. As described, the first surface 405 is formed by knitting a single jersey pattern using the first yarn 110 plated with the second yarn 112. This is indicated in FIG. 4 by the reference numeral 410 which shows an interlocking pattern of loops. Due to imperfections in the plating process, although the first yarn 110 forms the majority (e.g., greater than 80%, greater than 85%, greater than 90%, greater than 95% or above) of the first surface 405 of the textile 400, it is contemplated herein that the second yarn 112 may be present on the first surface 405. When the textile 400 is incorporated into a garment, the first surface 405 may form, at least in part, an outer-facing surface of the garment as will be explained in greater depth below.

Figure 5:
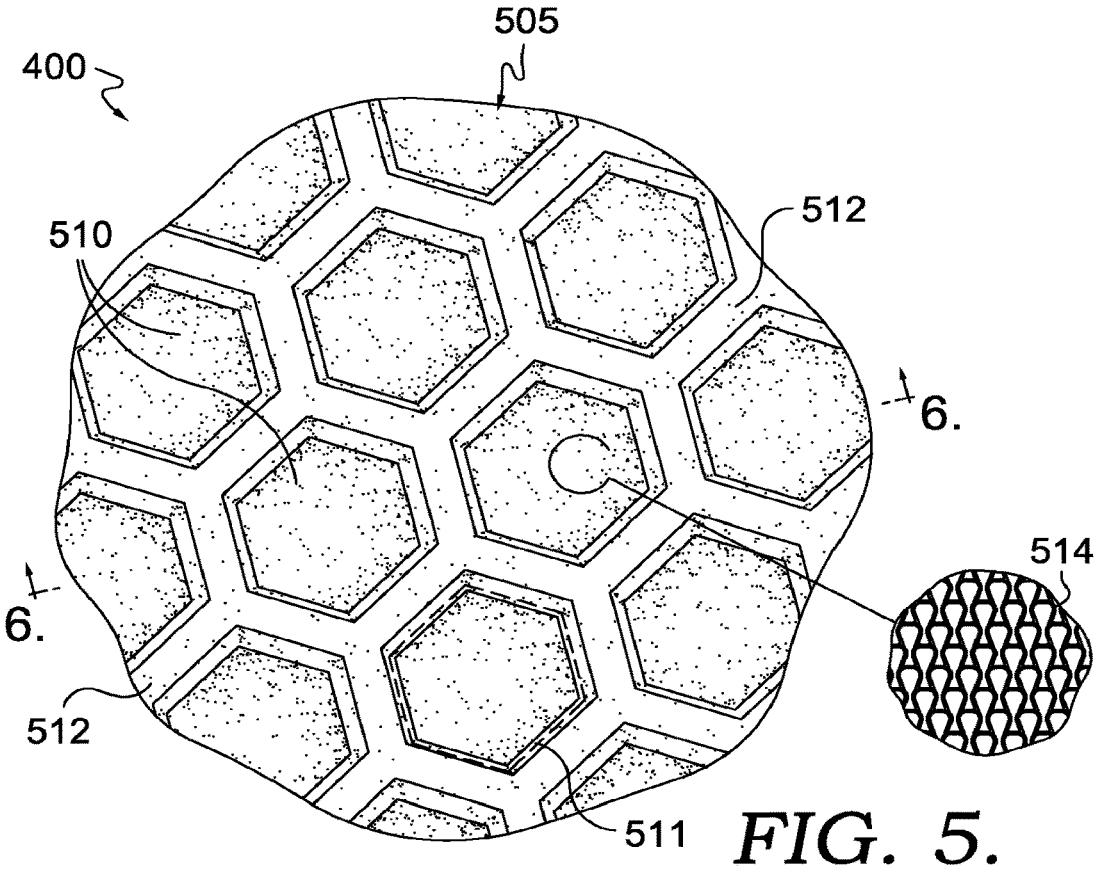
FIG. 5 illustrates a second opposite surface of the exemplary textile of FIG. 4 in accordance with aspects herein.

FIG. 5 illustrates a second surface 505 of the textile 400 incorporating the knit structure 100 in accordance with aspects herein. When the textile 400 is incorporated into a garment, the second surface 505 may form, at least in part, an inner-facing surface of the garment as will be explained in greater depth below. As described, the third yarn 114 is used to form a series of terry loops arranged in a set of projections 510 separated by spaces 512. This is shown in the close-up view in FIG. 5 and is indicated by the reference numeral 514. In exemplary aspects, the projections 510 extend in the z-direction with respect to the surface plane of the textile 400, and each projection 510 may terminate in a terminal end 511 (indicated by dashed lines) to form a node-like structure. This is better shown in a cross-sectional view such as that shown in FIG. 6.

Figure 6:
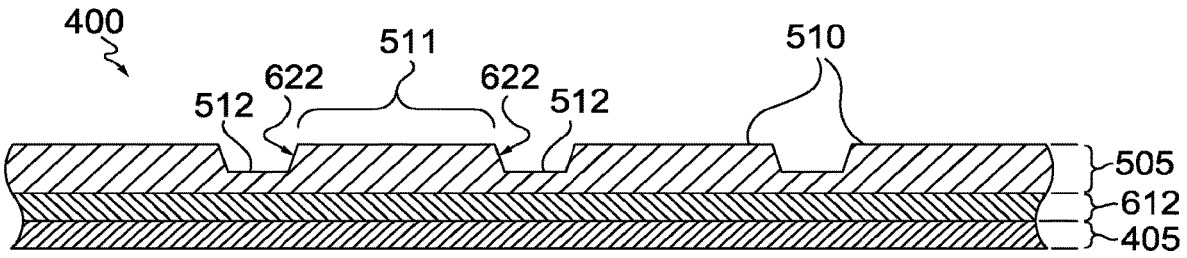
FIG. 6 illustrates a cross-section taken along cut line 6-6 of FIG. 5 in accordance with aspects herein.

FIG. 6, which is a cross-sectional view of the textile 400, depicts the first surface 405 generally comprising the first yarn 110. FIG. 6 further indicates a layer 612 comprising primarily the second yarn 112. FIG. 6 additionally illustrates the second surface 505 formed using the third yarn 114. As shown, the layer 612 formed using the second yarn 112 is generally positioned between or interposed between the first surface 405 formed using the first yarn 110 and the second surface 505 formed using the third yarn 114.

Continuing with respect to FIG. 6, the second surface 505 comprises projections 510 that extend in the z-direction with respect to the surface plane of the textile 400. Each projection 510 is spaced apart from an adjacent projection 510 by space 512. Further, each projection 510 comprises side portions 622 and a terminal end 511 located opposite, for instance, the first surface 405 and/or the second surface 505. In exemplary aspects, the side portions 622 may be substantially perpendicular to the surface plane of the textile 400 such that the terminal ends 511 of the projections 510 have a surface area that is similar to the surface area of the base of the projections 510. In another aspect, the side portions 622 may be angled such that the terminal ends 511 of the projections 510 have a smaller surface area than the surface area of the base of the projections 510. In yet another aspect, the side portions 622 may be angled with respect to the surface plane of the textile 400 such that the terminal ends 511 of the projections 510 have a greater surface area than the surface area of the base of the projections 510. Any and all aspects, and any variation thereof, are contemplated as being within the scope herein.

Figure 14:
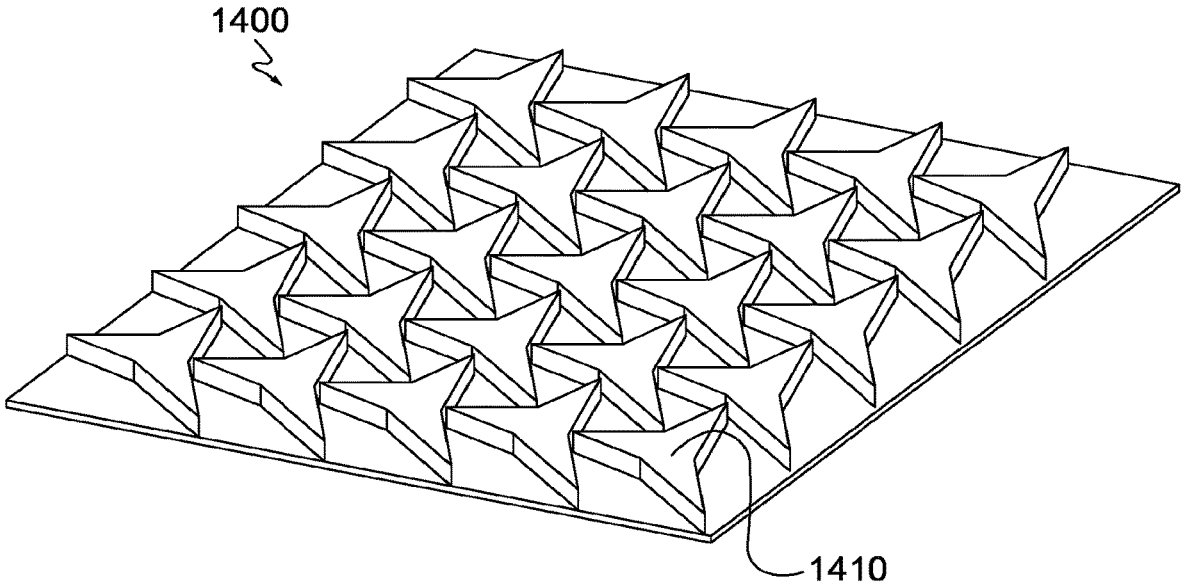
FIG. 14 illustrates an alternative exemplary projection shape for the second opposite surface of the exemplary textile of FIG. 4 in accordance with aspects herein.

Returning to FIG. 5, as shown, the projections 510 may be located adjacent to each other in a tessellation pattern. Utilizing such a pattern may help to maximize the number of projections 510 per unit area of the textile 400. Although shown as having a hexagonal shape, it is contemplated herein that the projections 510 may assume different shapes such as squares, rectangles, an auxetic structure such as a triad, triangles, circles, ovals, diamonds, and other known geometric shapes. For example, FIG. 14 illustrates another exemplary shape for projections 1400. The shape comprises a triad structure 1410 arranged in a tessellation pattern.

With respect to FIG. 5 again, each projection 510 may have an approximate diameter (measured from one side of the terminal end 511 to an opposing side of the terminal end 511) between, for instance, 5 mm and 50 mm although diameters above and below these ranges are contemplated herein. As stated, each projection 510 may be separated from adjacent projections 510 by space 512. The width of the spaces 512 between adjacent projections 510 may be between, for instance, 1 mm and 15 mm, although widths above and below these ranges are contemplated herein.

As shown in the close-up view of FIG. 5, the projections 510, including their terminal ends 511, are formed from the terry loops of the knit structure 100. Forming the projections 510 using a terry loop structure helps to increase the surface area of the projections 510 which, in turn, may be useful for trapping air when the textile 400 is incorporated into a garment and the garment is worn by a wearer. In an optional aspect, the terminal ends 511 of the projections 510 may be brushed to increase the surface area even further and to impart an increased softness or warmth to the projections 510. Thus, the insulation features provided by the projections 510 may be primarily due to the size and/or surface area of the projections 510, the brushed terminal ends, the density of the projections 510, and the like. In one exemplary aspect, the textile 400 with its projections 510 may have a thermal resistance of 0.05 RCT or less. RCT is a measure of thermal resistance and provides an indication of how well a textile keeps a wearer warm or insulated. In one exemplary aspect, thermal resistance may be measured using test method ISO 11092 Textiles—physiological effects—measurement of thermal and water-vapour resistance under steady state conditions (sweating guarded-hot-plate test). In an exemplary aspect, the RCT value of the textile 400 may decrease when the textile is exposed to a physical stimulus such as water. This may be due to, for instance, the increased permeability of the textile 400 after exposure to water. Any and all aspects, and any variation thereof, are contemplated as being within the scope herein.

In exemplary aspects, the spaces 512 between adjacent projections 510 may act as hinge points or flexion points allowing, for instance, adjacent projections 510 to flex toward one another or away from one another when the textile 400 is manipulated thereby increasing the pliability and/or drape of the textile 400. The pliability and/or drape of the textile 400 may also be increased through the use of the single knit construction. Moreover, the spaces 512 may act as conduits for air movement when the textile 400 is incorporated into a garment and the garment is worn. In other words, air may travel through the spaces 512 thereby providing a degree of ventilation to the textile 400 when incorporated into a garment. Thus, use of the projections 510 in combination with the spaces 512 between the projections 510 help to create a flexible textile that provides insulation to the wearer when the garment is worn while still enabling a degree of ventilation for improved wearer comfort.

As described, the third yarn 114 used to form the second surface 505 of the textile 400 may comprise a non-absorptive polyester yarn. In exemplary aspects, the second surface 505 of the textile 400 formed using the third yarn 114 may possess moisture-management characteristics (i.e., the ability of a textile to move moisture from one surface to an opposite surface through, for instance, capillary action, a denier differential, and the like). For example, moisture and/or perspiration may move from the wearer's body surface, between the yarn(s) 114 forming the projections 510, and to the second yarn 112. Once the moisture and/or perspiration has reached the second yarn 112 it may cause a dimensional transformation of the yarn 112 that results in an increase in air permeability of the textile 400 as described above with respect to FIGS. 3A and 3B.

Figure 7:
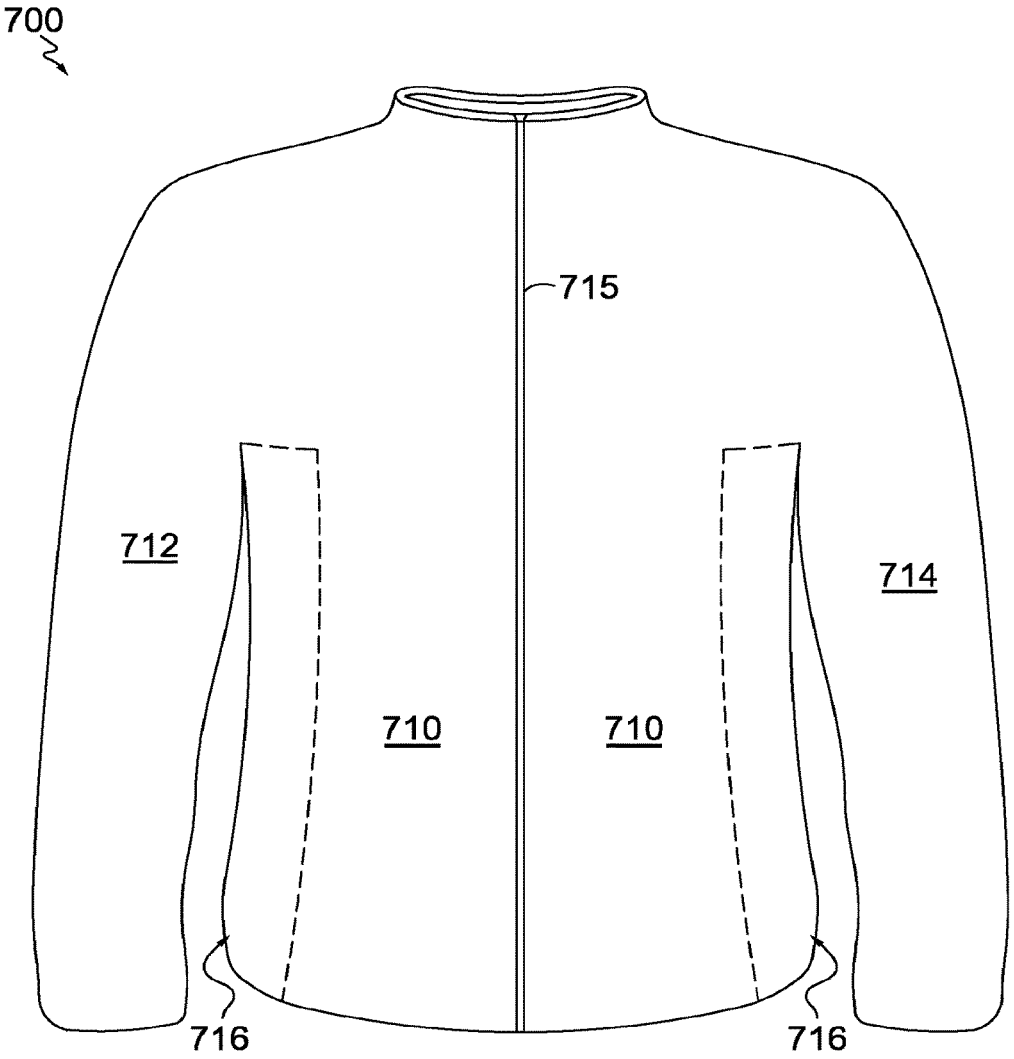
FIG. 7 illustrates a front view of an exemplary garment that incorporates the exemplary textile of FIGS. 4 and 5 in accordance with aspects herein.
Figure 8:
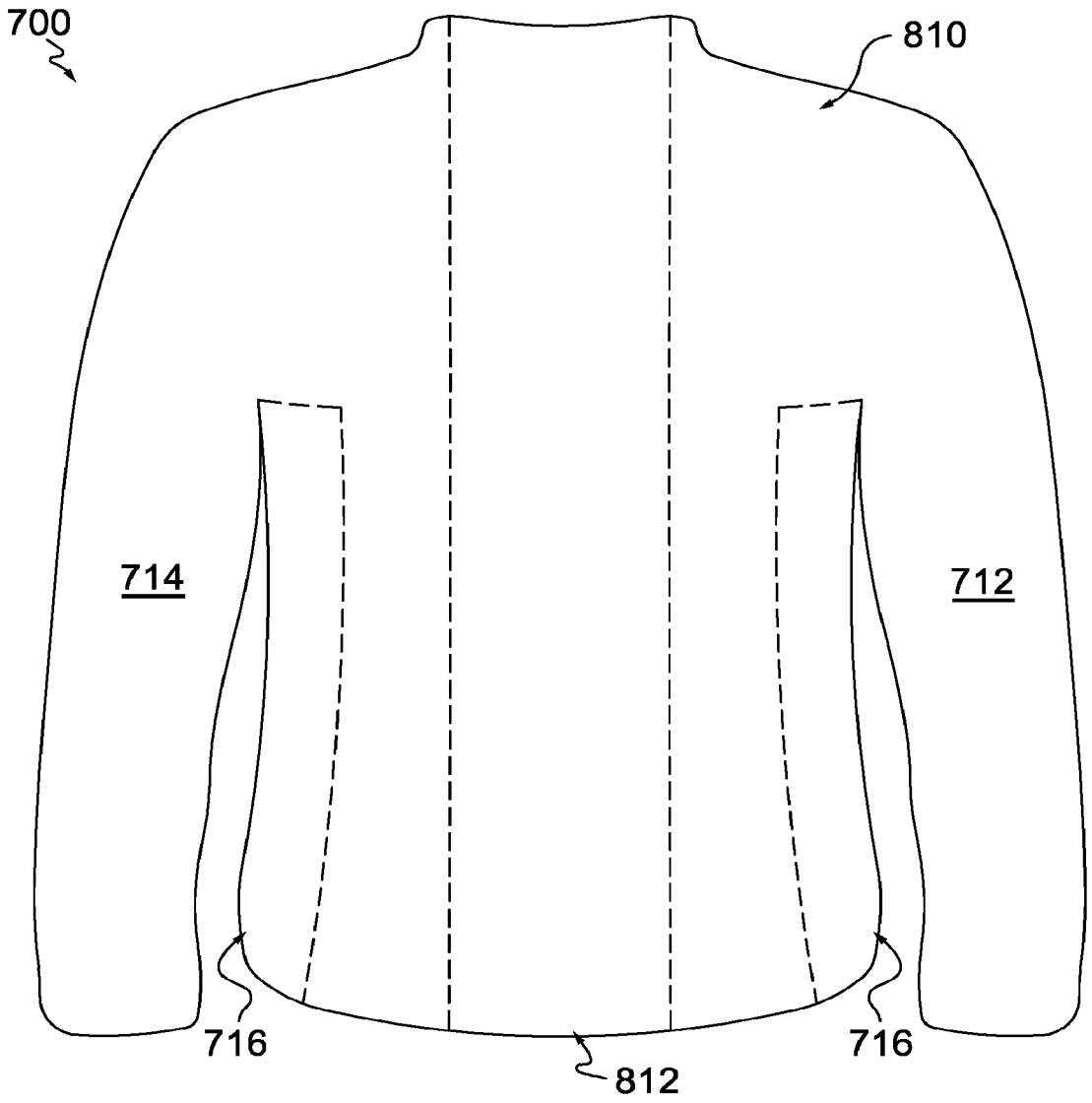
FIG. 8 illustrates a back view of the exemplary garment of FIG. 7 in accordance with aspects herein.

The textile 400, in exemplary aspects, may be incorporated into a garment. An exemplary garment 700 is shown in FIGS. 7 and 8 which respectively depict front and back views of the garment 700 in accordance with aspects herein. Although shown as a garment for an upper torso of a wearer, it is contemplated herein that the garment 700 may be in the form of a garment for a lower torso of a wearer (e.g., a pant, a short, a legging, a capri, and the like), or the garment 700 may take the form of a sock, a shin guard or other type of protective equipment, a hat, and the like. Any and all aspects, and any variation thereof, are contemplated as being within the scope herein. Moreover, although the garment 700 in FIGS. 7 and 8 is shown in the form of a jacket, it is contemplated herein that the garment 700 may be in the form of a shirt (pullover, hoodie, sweatshirt, and the like), a coat, and/or it may comprise a liner layer adapted to be worn under an external shell layer or an external shell layer adapted to be worn over a liner layer. As well, although not shown, the garment 700 may comprise an optional hood portion. Any and all aspects, and any variation thereof, are contemplated as being within the scope herein.

With respect to FIG. 7, the zoned garment 700 comprises at least a front portion 710 adapted to be positioned adjacent to a front torso area of a wearer when the garment 700 is worn, and a first and second sleeve portion 712 and 714 adapted to be positioned adjacent to the wearer's arms when the garment 700 is worn. As shown in FIGS. 7 and 8, the garment 700 further comprises side portions 716 indicated by dashed lines configured to be positioned adjacent to the side areas of the wearer when the garment 700 is worn. The side portions 716, in one exemplary aspect, may extend from an inferior margin of the sleeve openings for the sleeve portions 712 and 714 to near or at a waist opening of the garment 700 although it is contemplated herein that the side portions 716 may extend from an area proximate the sleeve openings for the sleeve portions 712 and 714 to an area proximate the waist opening of the garment 700. Any and all aspects, and any variation thereof, are contemplated as being within aspects herein. The garment 700 is shown with an optional releasable closure mechanism 715 (such as a zipper) that can be used to open and close the garment 700 for donning and doffing. When in the form of a shirt, the releasable closure mechanism 715 may not be utilized.

With respect to FIG. 8, the garment 700 further comprises a back portion 810 adapted to be positioned adjacent to a back torso area of the wearer when the garment 700 is worn. A central back portion 812 (indicated by dashed lines) may extend along an area adjacent to the wearer's spine when the garment 700 is worn. For example, the central back portion 812 may extend from a neck opening of the garment 700 to the waist opening of the garment 700 although it is contemplated herein that the central back portion 812 may extend from an area proximate the neck opening of the garment 700 to an area proximate the waist opening of the garment 700. Any and all aspects, and any variation thereof, are contemplated as being within aspects herein.

In exemplary aspects, the front portion 710, the back portion 810, and/or the sleeve portions 712 and 714 may be formed from separate panels that are affixed together to form the garment 700. In other aspects, the front portion 710, the back portion 810, and/or the sleeve portions 712 and 714 may be formed from a seamless construction utilizing, for example, a flat knitting process, a circular knitting process, and the like. Continuing, the side portions 716 may comprise integral extensions of the front portion 710 and/or the back portion 810, or the side portions 716 may comprise separate panels interposed between the front and back portions 710 and 810. Similarly, the central back portion 812 may comprise an integral extension of the back portion 810, or the central back portion 812 may comprise a separate panel(s) inserted into the back portion 810 Any and all aspects and any variation thereof, are contemplated as being within aspects hereof.

In exemplary aspects, some or all of the garment 700 may be formed using the textile 400. In one example, just the side portions 716 and the central back portion 812 may be formed from the textile 400 such that the outer-facing surface of these portions 716 and 812 may comprise the first surface 405 of the textile 400. In another example, the entirety of the garment 700 (including or excluding the sleeve portions 712 and 714) maybe formed from the textile 400 such that the outer-facing surface of the garment 700 comprises the first surface 405 of the textile 400. Other configurations are contemplated herein. For instance, different areas of the front portion 710 may be formed from the textile 400 such that the outer-facing surface of these areas may comprise the first surface 405 of the textile 400. Any and all aspects, and any variation thereof, are contemplated as being within aspects herein.

It is contemplated herein, that an additional backing layer may optionally be positioned on some or all of the outer-facing surface of the garment 700. With respect to this aspect, the backing layer may be affixed to the outer-facing surface of the garment 700 using, for instance, welding, adhesives, thermal bonding, stitching, and the like. In aspects, the backing layer may be selectively applied to the outer-facing surface of the garment 700 using for instance, adhesives applied in a dot pattern, spot welding, and the like to increase permeability and/or breathability characteristics of the garment 700. In aspects where the backing layer comprises a separate textile that is affixed to the outer-facing surface of the garment 700 to form a composite fabric, the backing layer may comprise, for instance, a double jersey fabric or a spacer mesh. Such materials may help to provide structure to the garment 700 while still providing breathability and/or permeability features. In exemplary aspects, different functional finishes, such as a durable water repellent, may be applied to the backing layer to help make the resulting garment 700 substantially impervious to water. Any and all aspects, and any variation thereof, are contemplated as being within aspects herein.

Figure 9:
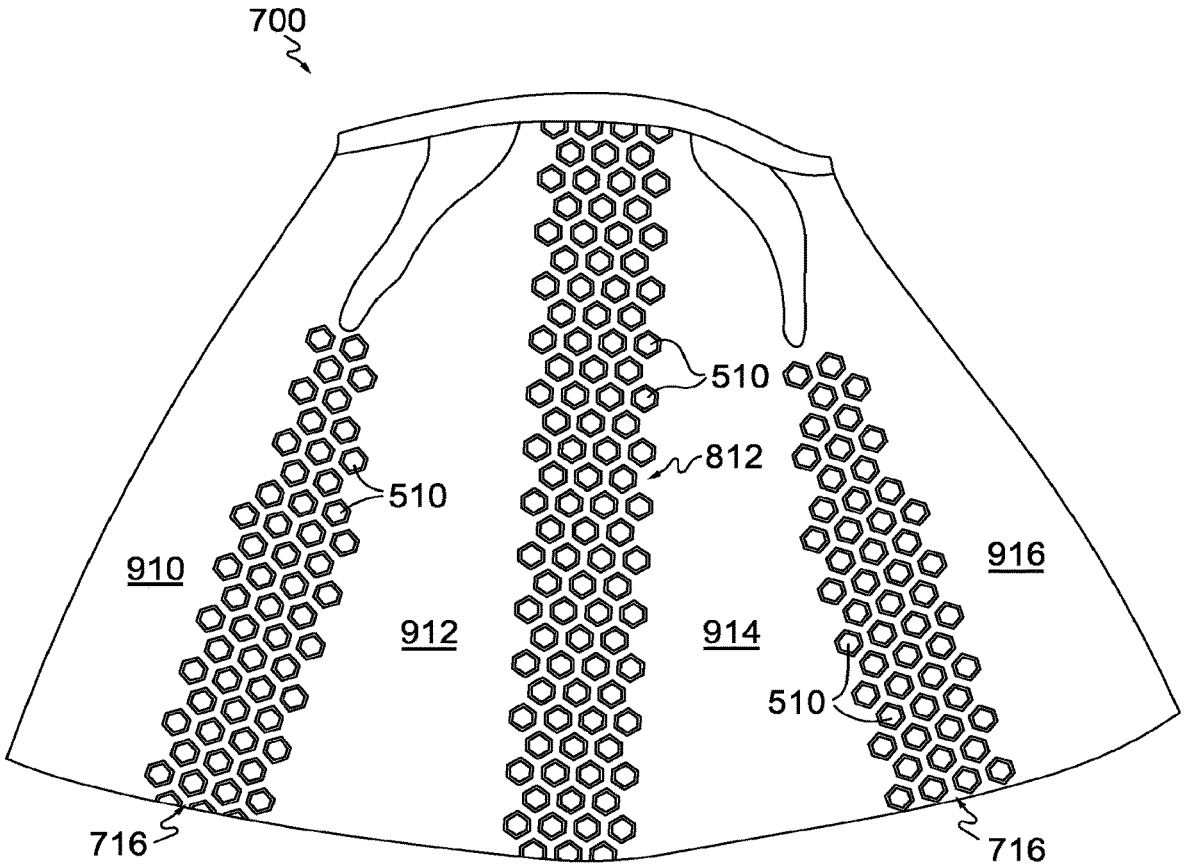
FIG. 9 illustrates the exemplary garment of FIG. 7 in an open state such that the interior of the garment is shown in accordance with aspects herein.

Turning now to FIG. 9, a front view of the garment 700 with the garment 700 in an open state such that the interior or inner-facing surface of the garment 700 is shown is provided in accordance with aspects herein. The textile 400 is shown as being incorporated into the garment 700 at least at the side portions 716 and the central back portion 812 of the garment 700. The selection of these areas may be based on, for instance, sweat or heat maps of the human body as the generation of sweat by the wearer may be used to trigger the dimensional transformation of, for instance, the second yarn 112. However, as described above, it is further contemplated herein that the textile 400 may be incorporated into other areas of the garment 700, such as the areas indicated by reference numerals 910, 912, 914, and/or 916, or the textile 400 may comprise the entirety of the garment 700 including or excluding the sleeve portions 712 and 714.

As shown in FIG. 9, the projections 510 of the textile 400 extend inwardly such that they face a body surface of a wearer when the garment 700 is worn. Although the projections 510 are shown as being generally equal in diameter, it is contemplated herein that the projections 510 may comprise different diameters. Because of the construction of the textile 400, the projections 510 may be used to provide insulation to the wearer. In other words, the terry loops of the projections 510 may help to trap heated air produced by the wearer and maintain the heated air in contact with the wearer's body. This is particularly useful when the wearer is at rest or is lightly exercising.

Continuing, when the wearer begins to exercise and to produce perspiration, it may be important to dissipate some of the wearer-generated heat to maintain the wearer within optimal temperature ranges. Because of the construction of the textile 400, the terry loops may help to wick the perspiration produced by the wearer to the second yarn 112 that is positioned adjacent to the second surface 505 of the textile 400. Once exposed to the perspiration, the second yarn 112 may undergo a dimensional transformation such as going from a crimped state to an uncrimped or flat state. As explained with respect to FIGS. 3A and 3B, this change causes an increase in the size of the openings formed by the loops of the first yarn 110 and the second yarn 112, with a resultant increase in permeability. The increase in permeability may help cool the wearer by allowing air from the ambient environment to funnel into the apparel item 700 and by creating a passageway by which moisture vapor and/or heat produced by the wearer can escape. Once the wearer has stopped perspiring, the second yarn 112 may transition back to a crimped state causing the permeability of the textile 400 to decrease with the result that the wearer's body heat is maintained.

With respect to the areas 910, 912, 914 and 916 in FIG. 9, these areas generally correspond to lower heat and/or sweat producing areas of the wearer when the garment 700 is worn. It is contemplated herein that a textile having a somewhat similar construction as the textile 400 but lacking the second yarn 112 may be used to form the areas 910, 912, 914, and 916. In other words, the textile would have an outer-facing surface similar to the surface 405 of the textile, and would further comprise projections such as the projections 510 of the textile 400, but would not include the adaptive second yarn 112. Thus, this textile may be useful for providing insulation features but would not undergo an increase in air permeability when the wearer begins producing sweat. Thus, by using a combination of the textile 400 in the portions 716 and 812, and the textile described above in the areas 910, 912, 914, and 916, a wearer of the garment 700 may maintain optimal temperature ranges during, for instance, exercise and at rest. It is also contemplated herein that other textiles may be used to form the areas 910, 912, 914, and 916. For instance, textiles without the projections shown in FIG. 5 may be used in these areas. Any and all aspects, and any variation thereof, are contemplated as being within aspects herein.

Figure 11:
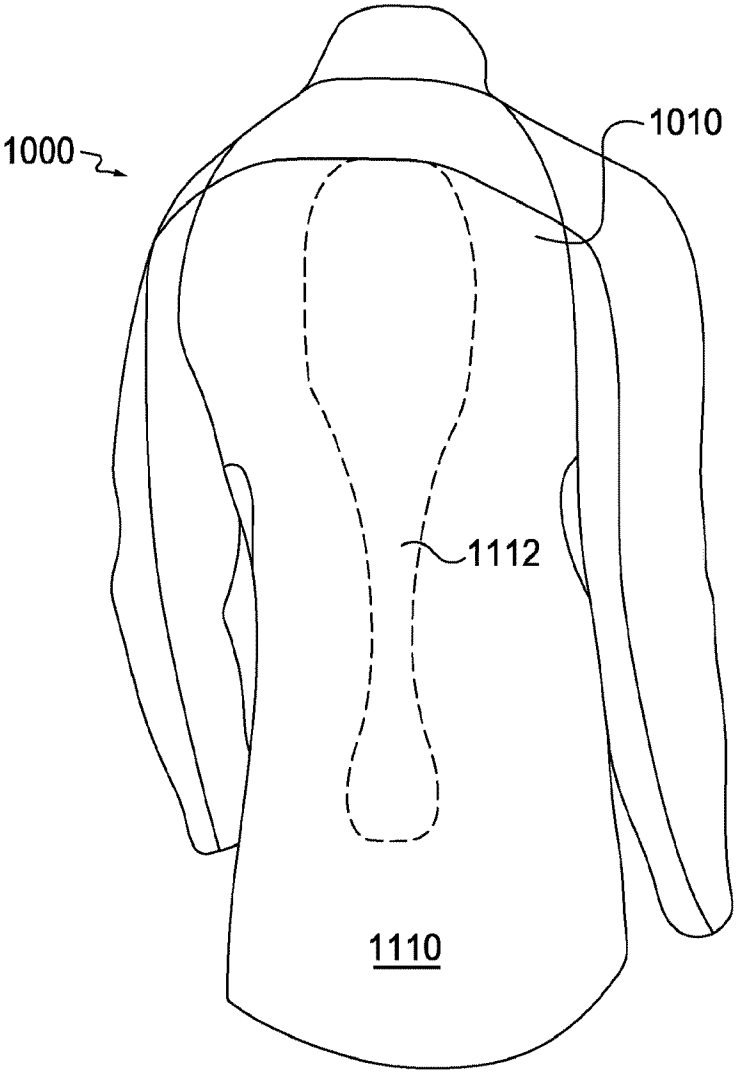
FIGS. 10 and 11 illustrate front and back perspective views of an exemplary garment that incorporates the exemplary textile of FIGS. 4 and 5 and in accordance with aspects herein.
Figure 10:
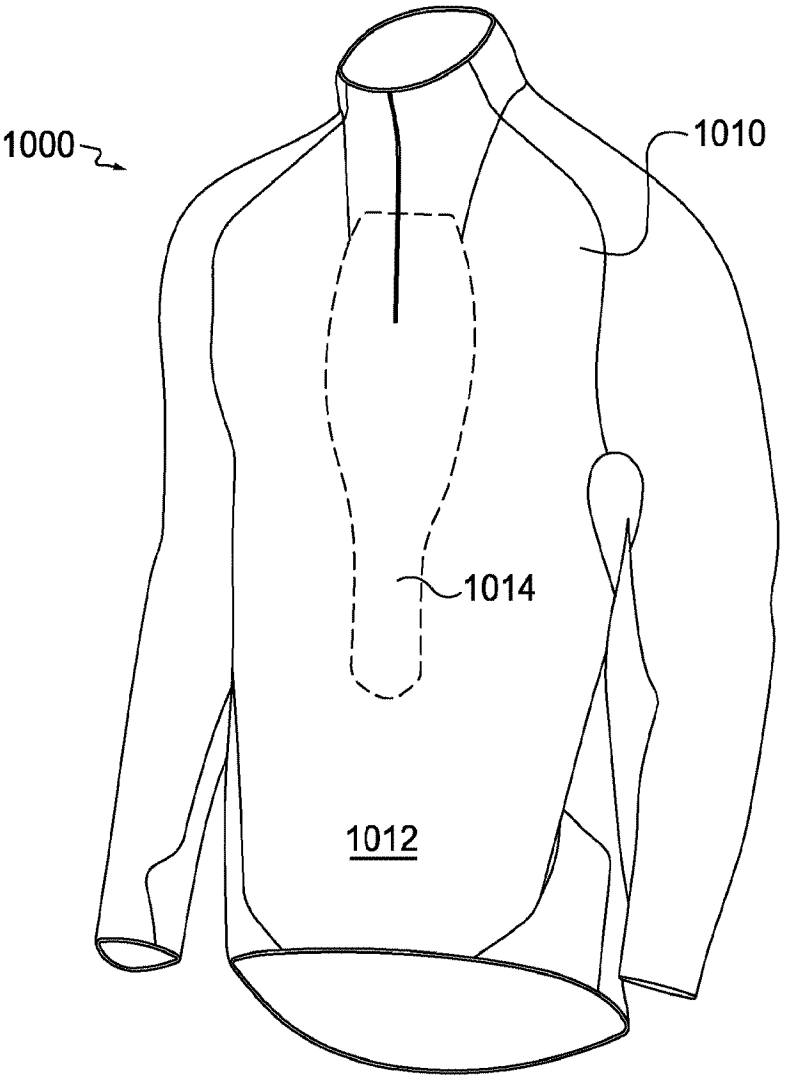

FIGS. 10 and 11 depict front and back perspective views respectively of an outer-facing surface of another exemplary garment 1000 in accordance with aspects herein. Much of the general discussion regarding the garment 700 is also applicable to the garment 1000. Similar to the garment 700, the garment 1000 comprises at least a torso portion 1010 having a front aspect 1012 (shown in FIG. 10) and a back aspect 1110 (shown in FIG. 11). The garment 700 is in the form of a pull-over shirt, although other configurations are contemplated herein such as a jacket, a vest, a pant, a short, a hat, a sock, and the like.

With respect to FIG. 10, an area indicated by the reference numeral 1014 and shown using dashed lines is illustrated as extending along a central portion of the front aspect 1012 of the torso portion 1010. The area 1014, in exemplary aspects, may extend from an area proximate the neck opening of the garment 1000 (i.e., within 5 to 15 cm of the neck opening) to an area approximately 5 to 40 centimeters from the bottom margin of the garment 1000. With respect to FIG. 11, an area indicated by the reference numeral 1112 and shown using dashed lines is illustrated extending along a central portion of the back aspect 1110 of the torso portion 1010. The area 1112, in exemplary aspects, may extend from an area proximate the neck opening of the garment 1000 (i.e., within 5 to 15 cm of the neck opening) to an area approximately 5 to 30 centimeters from the bottom margin of the garment 1000.

In exemplary aspects, the areas 1014 and 1112 may be formed from the textile 400. The areas 1014 and 1112 generally correspond to high sweat-producing areas of a wearer when the garment 1000 is worn. As such, forming these areas using the textile 400 increases the likelihood that the second yarn 112 will dimensionally transform and cause the textile 400 to undergo an increase in air permeability. Similar to the garment 700, other areas of the garment 1000 may be formed of a textile that does not include the adaptive second yarn 112. Any and all aspects, and any variation thereof, are contemplated as being within the scope herein.

Figure 13:
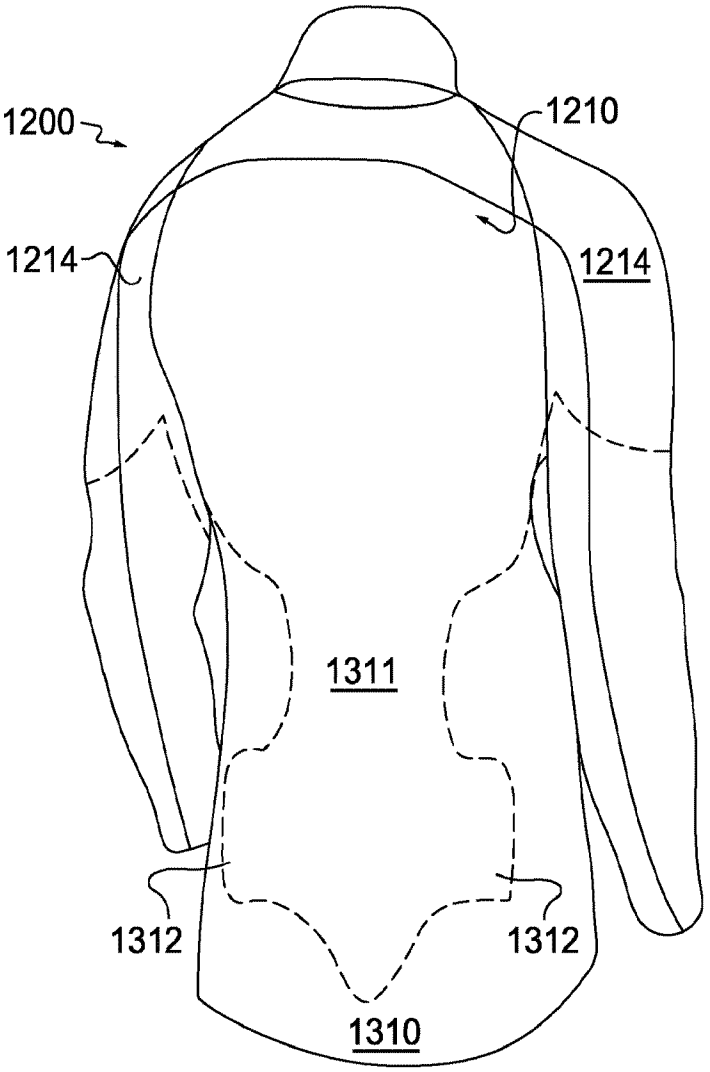
FIGS. 12 and 13 illustrate front and back perspective views of an exemplary garment that incorporates the exemplary textile of FIGS. 4 and 5 in accordance with aspects herein.
Figure 12:
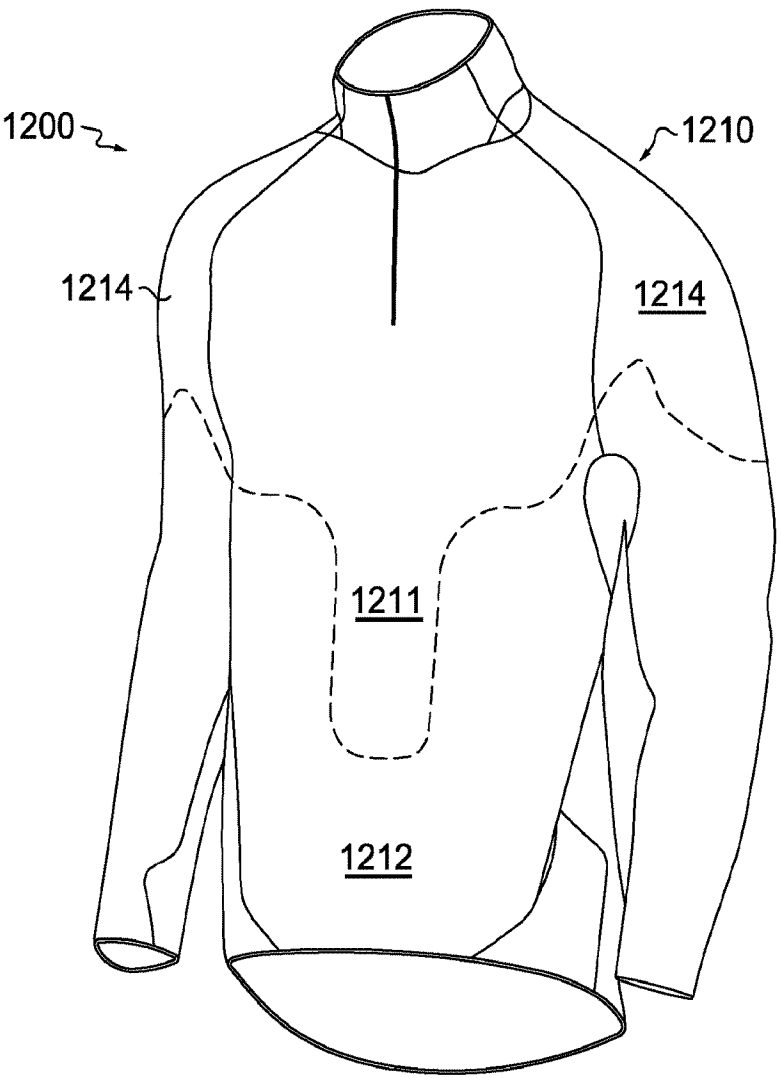

FIGS. 12 and 13 illustrate front and back perspective view respectively of another exemplary garment 1200 in accordance with aspects herein. Again, much of the general discussion regarding the garment 700 is also applicable to the garment 1200. The garment 1200 incorporates the textile 400 in additional areas besides those shown for the garment 1000 as shown by the dashed lines. The additional areas may generally correspond to medium sweat-producing areas of the wearer when the garment 1200 is worn. For instance, besides being incorporated in a central front aspect 1211 and a central back aspect 1311 of a torso portion 1210 similar to the garment 1000, the textile 400 may also be incorporated along shoulder regions 1214 of the torso portion 1210 and may extend from the shoulder regions 1214 to the central front and back aspects 1211 and 1311 of the torso portion 1210. It also may be incorporated along the lateral sides of the back aspect of the torso portion 1210 in an area proximate to the lower margin of the garment 1200 (i.e., in an area approximately 5 to 40 cm from the lower margin of the garment 1200) as indicated by the reference numeral 1312. Other areas of the garment 1200 may be formed of a textile that does not include the adaptive yarn 112. Any and all aspects, and any variation thereof, are contemplated as being within aspects herein.

The foregoing description of examples of the present invention have been provided for purposes of illustration and description. It is not intended to be exhaustive or to limit the invention. Individual elements or features of a particular example are generally not limited to that particular example, but, where applicable, are interchangeable and may be used in a selected example, even if not specifically shown or described.

What is claimed is:

1. An upper-torso garment comprising a knitted textile positioned in a first sleeve portion of the garment and a second sleeve portion of the garment, the knitted textile comprising:

a first surface and an opposite second surface;

a first yarn that is configured to be dimensionally stable upon exposure to moisture;

a second yarn that is configured to transition from a crimped state to an uncrimped state upon exposure to the moisture, the second yarn plated with the first yarn such that the first yarn generally forms the first surface of the knitted textile and the second yarn is generally positioned under the first yarn; and a third yarn forming the second surface of the knitted textile, the third yarn forming terry loops that extend from the second surface of the knitted textile, wherein the terry loops are clustered together in groups such that each group of terry loops forms a respective projection of a plurality of discrete projections, each projection of the plurality of discrete projections having a terminal end located opposite the first surface of the knitted textile, each projection of the plurality of discrete projections separated from an adjacent projection by a space, and each projection of the plurality of projections comprising side portions angled such that the terminal end has a smaller surface area than a surface area of a base of the projection.

2. The upper-torso garment of claim 1, wherein the third yarn is configured to be dimensionally stable upon exposure to moisture.

3. The upper-torso garment of claim 1, wherein the knitted textile is configured to exhibit a first air permeability when unexposed to the moisture and a second air permeability when exposed to the moisture, wherein the first air permeability is less than the second air permeability.

4. The upper-torso garment of claim 3, wherein the second air permeability is at least 25% greater than the first air permeability.

5. The upper-torso garment of claim 1, wherein the plurality of discrete projections are located adjacent to each other in a tessellation pattern.

6. The upper-torso garment of claim 1, wherein the first yarn comprises 50% non-absorptive polyester fibers or filaments and 50% non-absorptive cationic dyeable polyester fibers or filaments.

7. The upper-torso garment of claim 1, wherein the second yarn is a bi-component yarn formed from Nylon 6 fibers or filaments and non-absorptive cationic dyeable polyester fibers or filaments.

8. The upper-torso garment of claim 1, wherein the third yarn comprises 100% non-absorptive polyester fibers or filaments.

9. The garment of claim 1, wherein the first sleeve portion and the second sleeve portion are positioned adjacent to a wearer's respective arms when the garment is worn.

10. The garment of claim 1, wherein the garment comprises a jacket.

11. A garment comprising a knitted textile positioned in a back portion of the garment, the knitted textile comprising:

a first surface and an opposite second surface;

a first non-absorptive yarn;

a second yarn that is configured to transition from a crimped state to an uncrimped state upon exposure to moisture, the second yarn plated with the first yarn such that the first yarn generally forms the first surface of the knitted textile and the second yarn is generally positioned under the first yarn; and a third yarn forming the second surface of the knitted textile, the third yarn forming terry loops that extend from the second surface of the knitted textile, wherein the terry loops are clustered together in groups such that each group of terry loops forms a respective projection of a plurality of discrete projections, each projection of the plurality of discrete projections having a terminal end located opposite the first surface of the knitted textile, and each projection of the plurality of projections comprising side portions angled such that the terminal end has a smaller surface area than a surface area of a base of the projection.

12. The garment of claim 11, wherein the textile is positioned in a central back portion of the garment.

13. The garment of claim 11, wherein the garment comprises a jacket.

14. A garment comprising a knitted textile positioned in a front portion of the garment, the knitted textile comprising:

a first surface and an opposite second surface;

a first yarn that is dimensionally stable such that the first yarn does not undergo a measurable change in at least one of a length and a degree of crimp when exposed to a physical stimulus;

a second yarn that is configured to transition from a crimped state to an uncrimped state upon exposure to moisture, the second yarn plated with the first yarn such that the first yarn generally forms the first surface of the knitted textile and the second yarn is generally positioned under the first yarn; and a third yarn forming the second surface of the knitted textile, the third yarn forming terry loops that extend from the second surface of the knitted textile, wherein the terry loops are clustered together in groups such that each group of terry loops forms a respective projection of a plurality of discrete projections, each projection of the plurality of discrete projections having a terminal end located opposite the first surface of the knitted textile, and each projection of the plurality of projections comprising side portions angled such that the terminal end has a smaller surface area than a surface area of a base of the projection.

15. The garment of claim 14, wherein the first yarn is non-absorptive.

16. The garment of claim 14, wherein the front portion of the garment is positioned adjacent to a front torso area of a wearer when the garment is worn.

* * * * *